US007878768B2

(12) United States Patent
Muhs

(10) Patent No.: US 7,878,768 B2
(45) Date of Patent: Feb. 1, 2011

(54) VACUUM PUMP WITH WEAR ADJUSTMENT

(76) Inventor: David Muhs, 16051 Tonkawood Ct., Minnetonka, MN (US) 55345

( * ) Notice: Subject to any disclaimer, the term of this patent is extended or adjusted under 35 U.S.C. 154(b) by 987 days.

(21) Appl. No.: 11/625,171

(22) Filed: Jan. 19, 2007

(65) Prior Publication Data

US 2008/0175723 A1 Jul. 24, 2008

(51) Int. Cl.
*F04C 19/00* (2006.01)
*B23P 6/00* (2006.01)

(52) U.S. Cl. ..... 417/68; 29/888.021

(58) Field of Classification Search ..... 417/68; 415/126, 213.1; 29/888.021
See application file for complete search history.

(56) References Cited

U.S. PATENT DOCUMENTS

| | | | | |
|---|---|---|---|---|
| 0,640,345 | A | | 1/1900 | Wilberforce |
| 1,555,023 | A | | 9/1925 | Prokofieff |
| 1,735,754 | A | | 11/1929 | Hargis |
| 1,763,595 | A | | 6/1930 | Paatsch |
| 1,840,257 | A | | 1/1932 | Saxe et al. |
| 1,864,640 | A | | 6/1932 | Dalrymple |
| 1,891,267 | A | | 12/1932 | Mikkowski |
| 2,033,980 | A | | 3/1936 | Durdin, Jr. |
| 2,306,988 | A | | 12/1942 | Adams |
| 2,312,837 | A | * | 3/1943 | Jennings ..... 417/68 |
| 2,788,745 | A | | 4/1957 | Jennings |
| 3,035,781 | A | | 5/1962 | Wallen |
| 3,272,137 | A | | 9/1966 | Maitlen et al. |
| 3,315,879 | A | | 4/1967 | Jennings |
| 3,394,772 | A | | 7/1968 | Abold |
| 3,473,679 | A | | 10/1969 | Weichel |
| 3,518,028 | A | | 6/1970 | Minick |
| 3,522,997 | A | | 8/1970 | Rylewski |
| 3,543,368 | A | | 12/1970 | Marlow |
| 3,584,974 | A | | 6/1971 | Nicastro |
| 3,610,780 | A | | 10/1971 | Smith |
| 3,644,056 | A | | 2/1972 | Wiselius |
| 3,644,061 | A | | 2/1972 | McFarlin |
| 3,712,764 | A | | 1/1973 | Shearwood |

(Continued)

FOREIGN PATENT DOCUMENTS

| | | |
|---|---|---|
| DE | 573209 | 3/1933 |

(Continued)

OTHER PUBLICATIONS

Hidristal, Sectional Drawings Q-Hydralic, 1 page, Sep. 19, 1994.

(Continued)

*Primary Examiner*—Charles G Freay
(74) *Attorney, Agent, or Firm*—Seager, Tufte & Wickhem LLC

(57) ABSTRACT

A vacuum pump having components that are subject to wear may be adjusted to compensate for the wear. In some instances, a vacuum pump may include a housing and an impeller disposed at least partially within the housing. A gap between the housing and the impeller may be adjustable to compensate for wear. In some cases, the housing may include a ring that may be moved to adjust a tolerance (or gap) between the ring and the impeller. In some instances, the ring may be rotated to adjust this gap. In other instances, the ring may be translated to adjust the tolerance.

28 Claims, 15 Drawing Sheets

U.S. PATENT DOCUMENTS

| | | | | | |
|---|---|---|---|---|---|
| 3,771,900 | A | | 11/1973 | Baehr | |
| 3,867,070 | A | | 2/1975 | Sloan | |
| 4,019,680 | A | | 4/1977 | Norris | |
| 4,057,368 | A | | 11/1977 | Balling | |
| 4,067,663 | A | | 1/1978 | Brooks et al. | |
| 4,080,096 | A | | 3/1978 | Dawson | |
| 4,116,582 | A | | 9/1978 | Sloan | |
| 4,132,504 | A | * | 1/1979 | Fitch | 417/68 |
| 4,146,353 | A | | 3/1979 | Carrouset | |
| 4,183,721 | A | | 1/1980 | Peterson | |
| 4,386,886 | A | | 6/1983 | Neal | |
| 4,402,648 | A | | 9/1983 | Kretschmer | |
| 4,427,336 | A | | 1/1984 | Lake | |
| 4,443,158 | A | | 4/1984 | Bentele et al. | |
| 4,484,457 | A | | 11/1984 | Mugele | |
| 4,498,844 | A | | 2/1985 | Bissell et al. | |
| 4,515,180 | A | | 5/1985 | Napolitano | |
| 4,606,704 | A | | 8/1986 | Sloan | |
| 4,637,780 | A | | 1/1987 | Grayden | |
| 4,648,796 | A | | 3/1987 | Maghenzani | |
| 4,687,412 | A | | 8/1987 | Chamberlain | |
| 4,708,585 | A | | 11/1987 | Fukazawa et al. | |
| 4,737,073 | A | | 4/1988 | Grayden | |
| 4,762,465 | A | | 8/1988 | Friedrichs | |
| 4,781,529 | A | | 11/1988 | Rose | |
| 4,787,824 | A | * | 11/1988 | Cole | 417/54 |
| 4,881,614 | A | | 11/1989 | Hoshi et al. | |
| 4,902,199 | A | | 2/1990 | McDonald et al. | |
| 4,940,402 | A | | 7/1990 | McCormick | |
| 4,946,349 | A | | 8/1990 | Manabe et al. | |
| 4,973,993 | A | | 11/1990 | Allen | |
| 4,981,413 | A | | 1/1991 | Elonen et al. | |
| 4,989,572 | A | | 2/1991 | Giacomazzi et al. | |
| 4,992,028 | A | | 2/1991 | Schoenwald et al. | |
| 5,078,169 | A | | 1/1992 | Scheurenbrand et al. | |
| 5,078,573 | A | | 1/1992 | Peroaho et al. | |
| 5,114,312 | A | | 5/1992 | Stanislao | |
| 5,178,823 | A | | 1/1993 | Hughes | |
| 5,203,677 | A | | 4/1993 | Lix et al. | |
| 5,242,268 | A | | 9/1993 | Fukazawa et al. | |
| 5,328,274 | A | | 7/1994 | Wallace et al. | |
| 5,366,347 | A | * | 11/1994 | Hoglund | 417/53 |
| 5,380,042 | A | | 1/1995 | Hively et al. | |
| 5,464,329 | A | | 11/1995 | Senoo et al. | |
| 5,487,644 | A | | 1/1996 | Ishigaki et al. | |
| 5,489,195 | A | | 2/1996 | Domagalia et al. | |
| 5,536,147 | A | | 7/1996 | Lang | |
| 5,542,822 | A | | 8/1996 | Stretz et al. | |
| 5,580,222 | A | | 12/1996 | Bornemann | |
| 5,588,806 | A | | 12/1996 | Trimborn et al. | |
| 5,641,271 | A | | 6/1997 | Forrester et al. | |
| 5,653,582 | A | | 8/1997 | Harvey et al. | |
| 5,660,533 | A | | 8/1997 | Cartwright | |
| 5,673,940 | A | | 10/1997 | Gaisford et al. | |
| 5,797,377 | A | | 8/1998 | Fischerkeller | |
| 5,797,724 | A | | 8/1998 | Liu et al. | |
| 5,800,146 | A | | 9/1998 | Junemann et al. | |
| 5,807,067 | A | | 9/1998 | Burdick | |
| 5,846,420 | A | | 12/1998 | Bolton et al. | |
| 5,944,216 | A | | 8/1999 | Inaoka et al. | |
| 5,960,981 | A | | 10/1999 | Dodson et al. | |
| 5,997,242 | A | | 12/1999 | Hecker et al. | |
| 6,158,959 | A | | 12/2000 | Arbeus | |
| 6,315,524 | B1 | | 11/2001 | Muhs et al. | |
| 6,347,926 | B1 | | 2/2002 | Pyrhonen | |
| 6,390,768 | B1 | | 5/2002 | Muhs et al. | |
| 6,405,748 | B1 | | 6/2002 | Muhs et al. | |
| 6,409,478 | B1 | | 6/2002 | Carnes et al. | |
| 6,585,492 | B2 | | 7/2003 | Muhs et al. | |
| 6,692,234 | B2 | | 2/2004 | Muhs | |
| 7,011,505 | B2 | | 3/2006 | Muhs | |
| 2002/0125680 | A1 | | 9/2002 | Muhs et al. | |
| 2006/0110261 | A1 | | 5/2006 | Muhs | |

FOREIGN PATENT DOCUMENTS

| | | |
|---|---|---|
| DE | 694694 | 6/1938 |
| DE | 2913960 | 10/1979 |
| DE | 3040160 | 10/1980 |
| DE | 3840819 | 6/1990 |
| EP | 0333045 | 9/1989 |
| EP | 0556527 | 8/1993 |
| EP | 0606154 | 7/1994 |
| EP | 0701062 | 3/1996 |
| FR | 2748526 | 11/1997 |
| GB | 1284328 | 8/1972 |
| GB | 1488439 | 10/1977 |
| GB | 1542483 | 3/1979 |
| GB | 2147050 | 5/1985 |
| GB | 2181487 | 4/1987 |
| GB | 2303178 | 2/1997 |
| JP | 63186985 | 8/1988 |
| NL | 43462 | 1/1938 |
| SU | 779643 | 12/1975 |
| WO | 9211458 | 7/1992 |
| WO | 9301396 | 1/1993 |
| WO | 9816403 | 4/1998 |

OTHER PUBLICATIONS

Goldwin Pumps, Dri-Prime Contractors Pumps brochure, 4 pages, prior to Mar. 22, 1999.

SPP Pumps Ltd., Hydrostream Horizontal Split Case Pumps, brochure, 6 pages, prior to Mar. 22, 1999.

SPP Pumps Ltd., Literature Folio, 96 pages, prior to Mar. 22, 1999.

Principle of Operation, 1 page, prior to Mar. 22, 1999.

Pumping of Liquids and Gases, 1 page, prior to Mar. 22, 1999.

Parma Pompe, Omega.S brochure, 8 pages prior to Mar. 22, 1999.

Neyrtec—Alstrhom ATlantique: "Hydro Vakuumpumpen und—verdichter der Reihen NS-CNS,"S.A. IMP. Boissy & COL0MB., Grenoble XP002253993, Jul. 1979. (No English translation. This article is relevant because it was cited on the Supplementary European Search Report).

W.H. Faragallah: "Liquid Ring Vacuum Pumps and Compressors," Applications and Principles of Operation, pp. 65-102, 1998.

* cited by examiner

VACUUM PUMP WITH WEAR ADJUSTMENT

TECHNICAL FIELD

The present invention generally relates to pumps, and more specifically, to vacuum pumps that are subject to wear.

BACKGROUND

A variety of pumping systems are known. Some pumping systems are used in industrial or other commercial applications. Such pumping systems may be used, for example, to evacuate ground water from a construction site. In some cases, a vacuum pump, such as a liquid ring vacuum pump, may be used to help prime a larger pump such as a centrifugal pump.

It is known that such liquid ring vacuum pumps are often subject to wear, especially when used in relatively dirty environments. In such environments, the water system for the liquid ring vacuum pump can accumulate dirt and other solids over time. As internal pump components wear, the pumps tend to loose efficiency and/or effectiveness. In many cases, after such wear occurs, the entire vacuum pump or at least the worn parts must be replaced, often at considerable expense. What would be desirable, therefore, is a vacuum pumping system that is made adjustable to compensate for such wear.

SUMMARY

The present invention relates generally to vacuum pumps that are adjustable to compensate for wear that occurs within the pump. In some instances, the vacuum pump may be a liquid ring vacuum pump that includes a housing and an impeller disposed at least partially within the housing. The impeller may be placed eccentrically with respect to the housing, with a liquid such as water filling at least part of a lower portion of the housing. An eccentric space is typically provided between the housing and the impeller, with the liquid in the housing filling the space to provide a seal between the impeller and the housing during operation of the vacuum pump.

In such vacuum pumps, which have an impeller that is eccentrically placed with respect to the housing, a smaller gap or clearance is typically provided between the top of the housing and the impeller than at the bottom. During operation, the spinning impeller causes at least some of the liquid in the housing to move up and provide a seal along the gap. It has been found that the size of the gap, particularly at or near the top of the housing and the impeller, can influence the ultimate efficiency and/or effectiveness of the vacuum pump. As such, is often desirable to keep the size of this gap within a tolerance range. To increase the useful life and/or maintain the efficiency and/of effectiveness of the vacuum pump, it is contemplated that this gap or clearance between the impeller and the housing may be made adjustable to help compensate for wear in the housing and or impeller components.

In some cases, the vacuum pump housing may include a ring that extends around the impeller that is movable so that a gap between the ring and the impeller may be adjusted. In one illustrative embodiment, the ring may have an eccentric bore, or the ring may have a concentric bore with an eccentric bore or recess machined into one end of the ring. In either case, and to adjust the gap spacing between the ring and the impeller, the ring may be rotated relative to the impeller. Alternatively, or in addition, the ring may be simply translated to adjust the gap between the ring and the impeller.

The above summary is not intended to describe each disclosed embodiment or every implementation of the present invention. The Figures, Detailed Description and Examples which follow more particularly exemplify these embodiments.

BRIEF DESCRIPTION OF THE FIGURES

The invention may be more completely understood in consideration of the following detailed description of various embodiments of the invention in connection with the accompanying drawings, in which.

Figure 1:
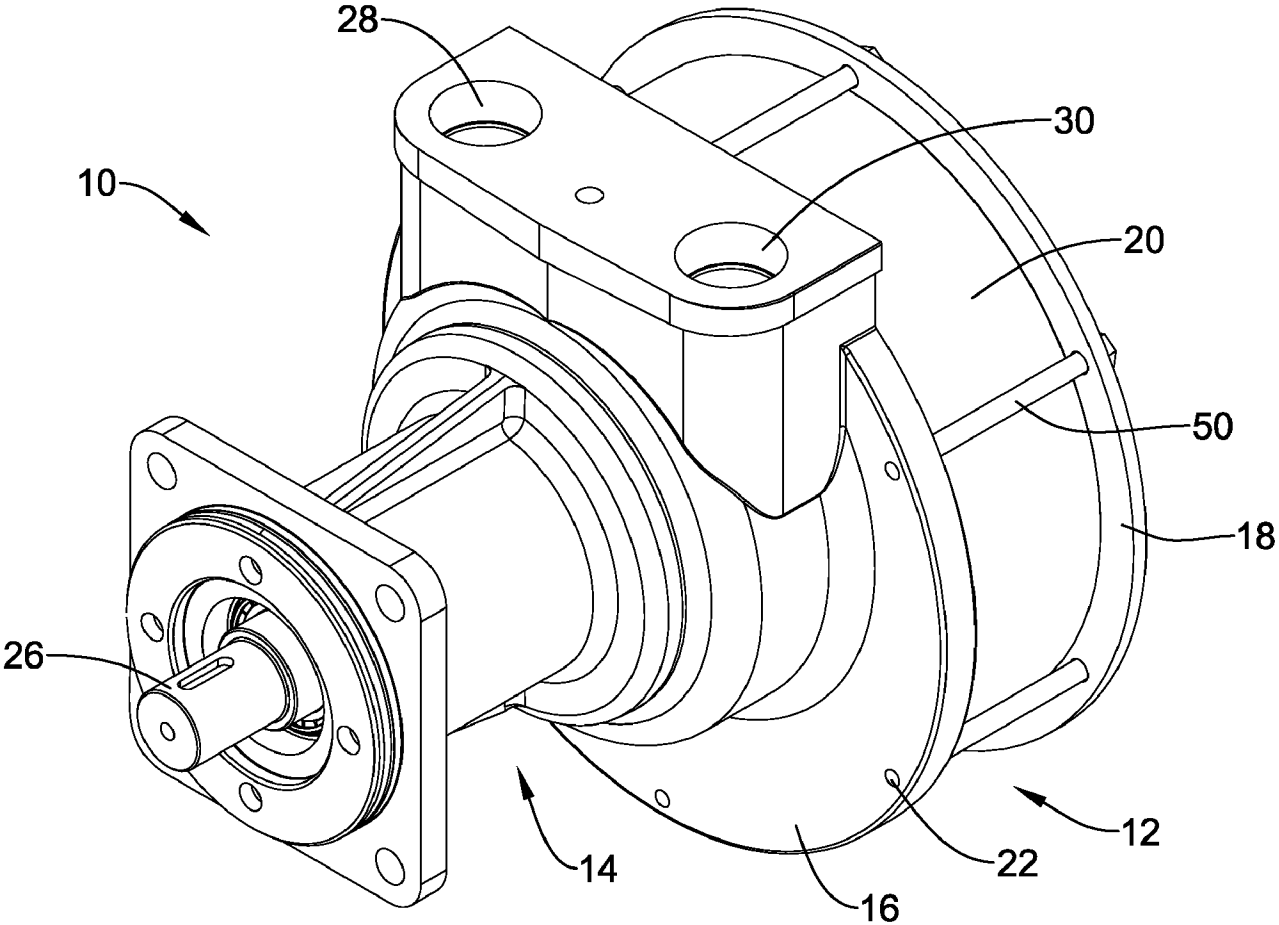
FIG. 1 is a perspective view of an illustrative liquid ring vacuum pump in accordance with an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

The invention generally relates to pumps. While the invention is described with respect to a liquid ring vacuum pump, this is merely for illustrative purposes and is not intended to limit the invention in any way.

FIG. 1 is a perspective view of a liquid ring vacuum pump 10. Liquid ring vacuum pump 10 has a housing 12 that includes a bearing housing 14, a back plate 16, a cover plate 18 and a ring 20 that is disposed between back plate 16 and cover plate 18. In some cases, cover plate 18 and/or ring 20 may be formed of a material that is sufficiently flexible and/or elastic to resist damage that could otherwise occur as a result of water freezing within housing 12. In some instances, cover plate 18 may be formed of a polymeric material. If desired, ring 20 may be formed of a polymeric material. In other embodiments, the cover plate 18 and/or ring 20 may be formed from steel, aluminum or any other suitable material, as desired.

Figure 2:
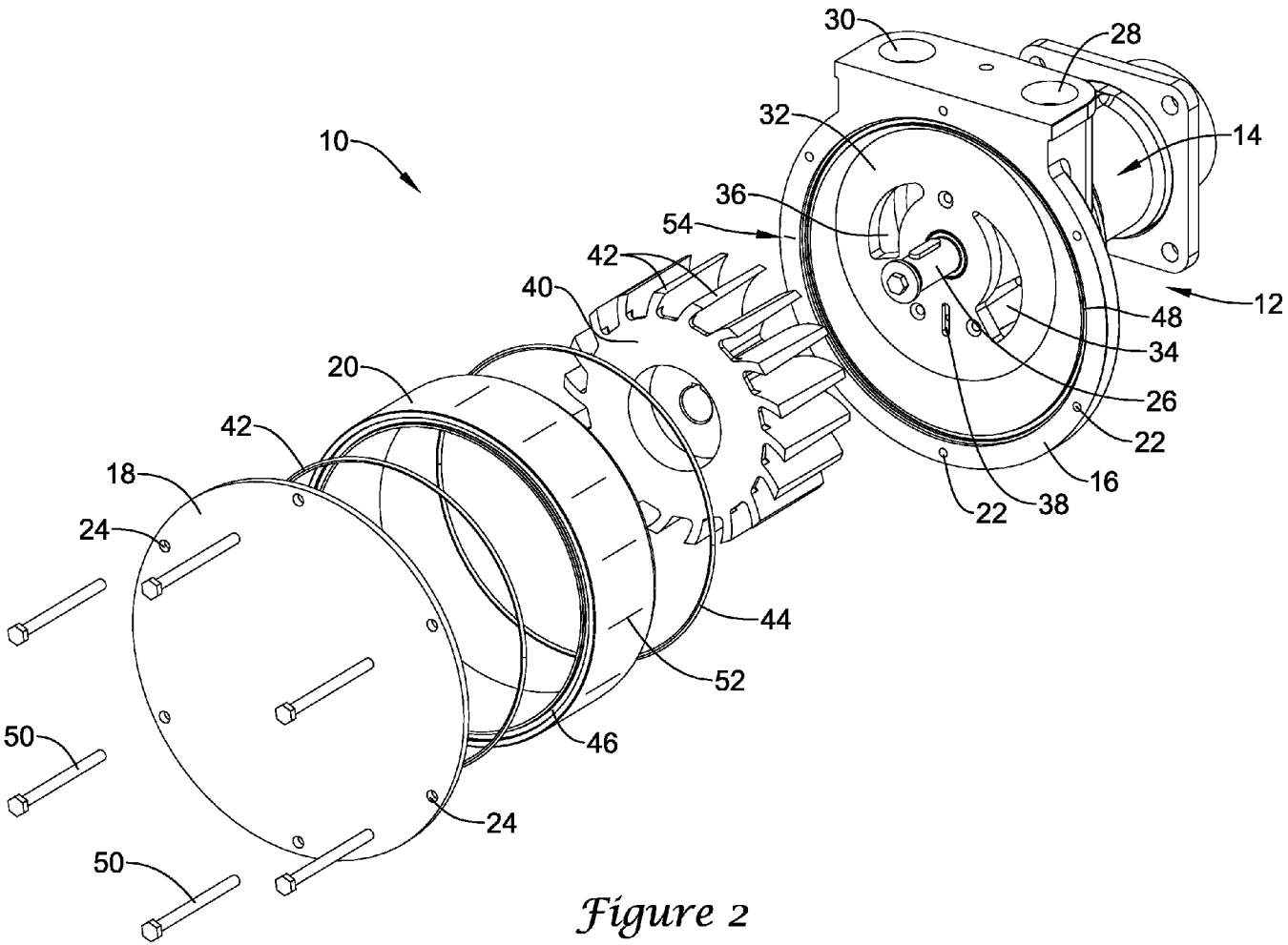
FIG. 2 is an exploded rear perspective view of the liquid ring vacuum pump shown in FIG. 1.

In some instances, as illustrated, back plate 16 may include one or more threaded apertures 22 that align with one or more bolt apertures 24 that are formed within cover plate 18. As shown in FIG. 2, one or more bolts 50 (or similar fasteners such as screws or rivets) may be extended through the one or more bolt apertures 24 and into the one or more threaded apertures 22 to secure cover plate 18 relative to back plate 16 and, in the process, secure ring 20 therebetween.

Liquid ring vacuum pump 10 may be configured to accommodate a shaft 26 that extends through housing 12 and drives an impeller (see FIG. 2, reference numeral 42). Shaft 26 may be driven in any suitable manner. In some cases, especially if liquid ring vacuum pump 10 is used to maintain a prime for a larger pump, such as a larger centrifugal pump, shaft 26 may be driven by the same engine that is being used to drive the larger pump. In some instances, shaft 26 may be driven by a separate, smaller, electrical motor or a fuel-driven engine, if desired.

Housing 12 may, if desired, include an inlet bore 28 and an outlet bore 30. As will be discussed with respect to FIG. 2, inlet bore 28 and outlet bore 30 may be in fluid communication with internal flow chambers that are, in turn, in fluid communication with the appropriate portions of a port plate 32. In some instances, the internal flow chambers present within housing 12 may be similar to those shown and described in U.S. Pat. No. 6,315,524, which is herein incorporated by reference in its entirety. Housing 12 may also include mounting apertures, mounting brackets and the like in order to secure liquid ring vacuum pump 10 as appropriate.

FIG. 2 is an exploded rear perspective view of liquid ring vacuum pump 10, showing some of the structures provided underneath cover plate 18. A port plate 32 is disposed against back plate 16. It can be seen that port plate 32 is located eccentrically with respect to back plate 16.

The illustrative port plate 32 includes an intake port 34 that may be in fluid communication with an intake chamber (not illustrated) that may, in turn, be in fluid communication with intake bore 28. The illustrative port plate 32 also includes a discharge port 36 that may be in fluid communication with a discharge chamber (not shown) that may, in turn, be in fluid communication with discharge bore 30. A water intake port 38 is also disposed within port plate 32. In some cases, water intake port 38 may be in fluid communication with a water chamber formed within housing 12, and may also be in fluid communication with a water intake bore (not shown). Details regarding the intake chamber, the discharge chamber and the water chamber are further discussed in the aforementioned U.S. Pat. No. 6,315,524.

An impeller 40 is disposed in front (as illustrated in FIG. 2) of port plate 32 and may be secured to shaft 26. The illustrative impeller 40 includes a plurality of curved vanes 42, but this is not required. For example, the impeller 40 may include a plurality of straight or other shaped vanes, if desired. In some cases, using curved vanes 42 may help increase the performance of vacuum pump 10 over a vacuum pump that uses straight vanes.

In some instances, the size and shape of each of these ports may be defined to provide optimal performance, if desired. As noted above, the cavity defined by the housing 12 may be filled at least partially with a liquid such as water. In some cases, the housing 12 is filled about half-way, but it is contemplated that other amounts of liquid may be used. As impeller 40 rotates past intake port 34 eccentrically to the ring 20 and casing, the liquid between the vanes 42 of the impeller 40 may be at least partially expelled leaving a void between the vanes 42 thereby creating a vacuum. This vacuum pulls air through the intake port 34, which is conveyed into the impeller casting and becomes trapped between the impeller vanes 42. As the cycle progresses toward the discharge port 36 eccentrically to the ring 20 and casing, at least some of the liquid is forced into the space between the vanes 42, pushing the trapped air out of the discharge port 36. A small amount of liquid typically discharges with the gas. Therefore, a small amount of make-up liquid may be provided via water intake port 38. This make-up liquid helps maintain the liquid ring, and also absorbs the heat energy of the compression.

In the illustrative design shown, the discharge port 36 is smaller than the intake port 34. Both the intake port 34 and the discharge port 36 are crescent shaped with one blunt end. The blunt end of the intake port 34 is arranged so that a rotating vane 42 of an impeller 40 passes over the blunt end after passing over the rest of the intake port 34. This tends to increase the vacuum that draws gas into the space between the vanes 42 of the impeller 40. In contrast, the blunt end of the discharge port 36 is arranged so that a rotating vane 42 of the impeller 40 passes over the blunt end before passing over the rest of the discharge port 36. The narrowing of the discharge port 36 tends to increase the pressure between the vanes, thereby forcing the gas from the space between the vanes 42 of the impeller 40.

In some cases, if desired, the exhaust of liquid ring vacuum pump 10 may be provided through discharge bore 30. The vacuum pump discharge may include both air and water. To recapture the water, the vacuum pump discharge may be provided across a relatively cool surface, which tends to cool and condense the water onto the cool surface. The cooled water can then be collected and provided back to vacuum pump 10. This closed loop system may allow liquid ring vacuum pump 10 to operate continuously for longer periods of time without having to add significant quantities of water.

In some cases, if desired, the vacuum pump discharge may be provided to a muffler that can include one or more baffles in order to reduce the noise before the vacuum pump discharge is released to the atmosphere. In some instances, it is contemplated that the exhaust of vacuum pump 10 may pass through a heat exchanger assembly that can be used to cool the exhaust and thereby condense water therein.

The illustrative embodiment shown in FIG. 2 shows both the intake bore 28 and discharge bore 30 located on the same side of the impeller 40. It is contemplated, however, that the intake bore 28 and the discharge bore 30 may be positioned on opposite sides of the impeller 40. When so provided, an intake port plate having an intake port 34 may be positioned on the side of and adjacent to the intake bore, and a discharge port plate having a discharge port 36 may be positioned on the side of and adjacent to the discharge bore. Another casting, having the discharge port, may then replace the cover plate 18.

In some cases, seals such as O-rings may be used to provide a seal between base plate 16, cover plate 18 and ring 20. As illustrated, a first O-ring 42 may be disposed between cover plate 18 and ring 20 while a second O-ring 44 may be disposed between ring 20 and back plate 16. First O-ring 42 and second O-ring 4 may, if desired, be formed of any resilient material such as rubber.

While not required, in some cases, first O-ring 42 may fit at least partially into a groove 46 that is formed in ring 20. In some instances, back plate 16 may include a groove 48 that accommodates second O-ring 44 as well as part of the ring 20 itself. In some cases, groove 48 may include, in cross-section, a rectangular portion sized to accommodate the edge of ring 20 as well as a dished or curved center (in cross-section) portion sized and shaped to accommodate second O-ring 44.

In some cases, first O-ring 42 and/or second O-ring 44 may be sized and configured to permit some movement of ring 20 relative to back plate 16 (and hence relative to impeller 40). In some cases, ring 20 may be eccentric, and may be rotated to compensate for wear of ring 20 and/or impeller 40. In some instances, ring 20 may be concentric, and may be translated to compensate for wear of ring 20 and/or impeller 40.

In some instances, as illustrated, ring 20 may include one or more setpoint markings 52 that may be used in ascertaining a rotational position of ring 20 with respect to back plate 16. Back plate 16 may include an alignment mark 54. In some cases, ring 20 may include a plurality of setpoint markings 52 that are equally or otherwise spaced. If desired, back plate 16 may include two or more alignment marks.

It will be recognized from FIG. 2 that the gap or clearance between impeller 40 and ring 20 is at a maximum at the bottom of ring 20 and is at a minimum at the top of ring 20 (in the illustrated orientation). As noted above, this change in clearance between ring 20 and impeller 40 assists in forming a liquid ring that permits operation of vacuum pump 10. It will be recognized that the minimum gap, or clearance, between ring 20 and impeller 40, particularly at the top thereof, can have a significant impact on the performance and/or efficiency of vacuum pump 10.

Figure 3:
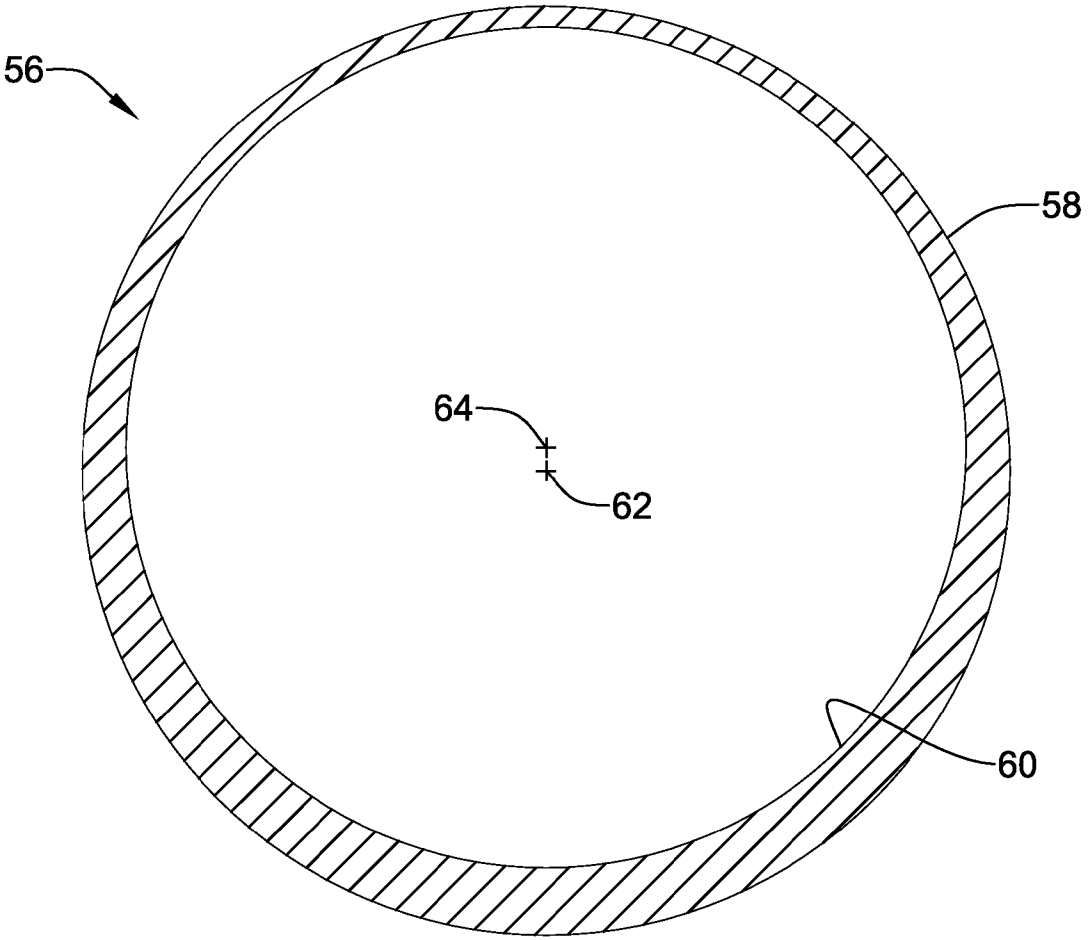
FIG. 3 is a schematic view of an eccentric ring that may be used in accordance with an illustrative embodiment of the present invention.

FIG. 3 is a schematic illustration of an eccentric ring 56 that may be used within vacuum pump 10. It will be recognized that in FIG. 3, the eccentricity of eccentric ring 56 has been exaggerated for illustrative purposes, and may represent one illustrative embodiment of ring 20 of FIG. 2. In some instances, eccentric ring 56 may have an outer annular surface 58 and an inner annular surface 60. Outer annular surface 58 may be considered as defined by a first circle having a first center 62 and inner annular surface 60 may be considered as defined by a second circle having a second center 64. It can be seen that second center 64 is offset from first center 62. In some illustrative embodiments, second center 64 may be offset by a distance of about 0.010 inch to about 0.200 inch from first center 62.

Figure 4:
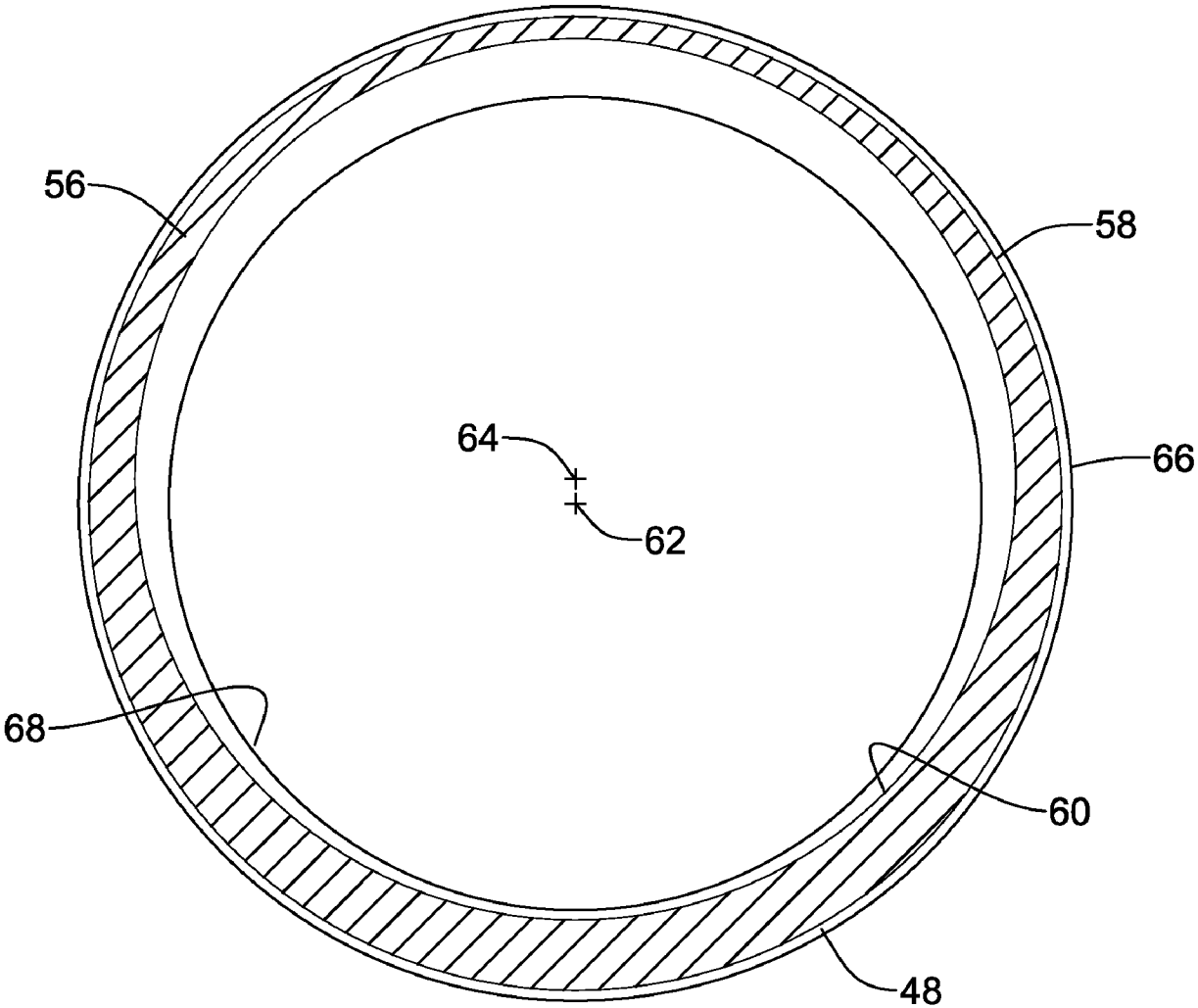
FIG. 4 is a schematic view of the eccentric ring of FIG. 3 used in conjunction with the liquid ring vacuum pump of FIG. 1.

FIG. 4 is a schematic illustration of eccentric ring 56 of FIG. 3 disposed within an annular groove 48 in back plate 16. It can be seen that annular groove 48 has an outer perimeter 66 that is concentric with outer annular surface 58 and that is sized to accommodate outer annular surface 58 of the eccentric ring 56. Annular groove 48 may have an inner perimeter 68 that is concentric with outer perimeter 66 and that is sized to accommodate a maximum wall thickness of eccentric ring 56.

It can be seen that a tolerance between eccentric ring 56 and impeller 40 (when eccentric ring 56 is used as ring 20 of FIG. 2) may be adjusted by rotating eccentric ring 56 relative to back plate 16 (FIG. 2). In some cases, eccentric ring 56 may be rotated by loosening one or more of the plurality of bolts 50 so that eccentric ring 56 is free to rotate, then rotating eccentric ring 56, followed by re-tightening the loosened bolts 50. It is contemplated that, for example, eccentric ring 56 may be rotated until it binds against impeller 40, and then reversed slightly. In some cases, eccentric ring 56 may include one or more setpoint markings that may be aligned against an alignment mark on back plate 16. These setpoint markings may be used not only for guiding adjustments, but also for initial assembly, if desired.

In some cases, it may be desirable to completely remove cover plate 18 (FIG. 2) so that the gap or tolerance between eccentric ring 56 and impeller 40 may be visually or mechanically inspected. In some instances, a feeler gauge may be used to ascertain the gap or tolerance between eccentric ring 56 and impeller 40. In some cases, an acceptable tolerance between eccentric ring 50 and impeller 40 may be in the range of about 0.040 inch to about 0.090 inch, but other tolerances may be used, as desired.

Another advantage to completely removing cover plate 18 is that this permits a visual inspection of impeller 40, so that any broken or bent vanes 42 may be recognized. If such damage is found, it may be necessary to replace impeller 40. When replacing cover plate 18, it may be desirable to reverse cover plate 18, especially if one side of cover plate 18 (the side previously facing impeller 40) is partially worn. This may extend the useful life of the cover plate 18.

Figure 5:
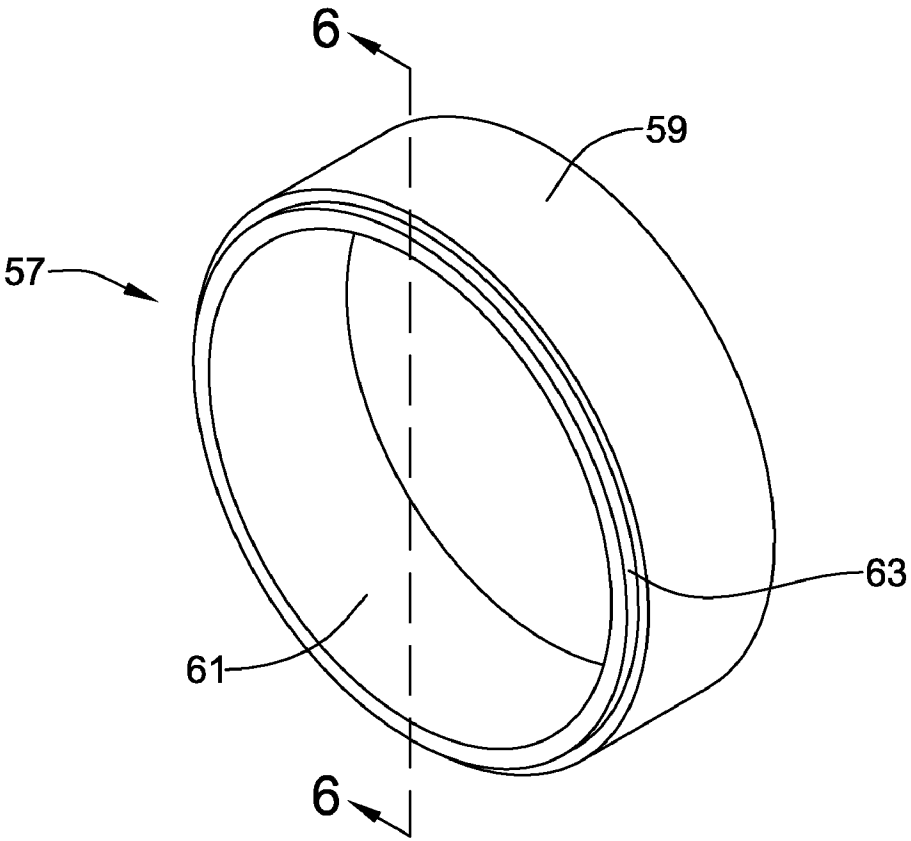
FIG. 5 is a schematic view of an eccentric ring that may be used in accordance with an illustrative embodiment of the present invention.
Figure 6:
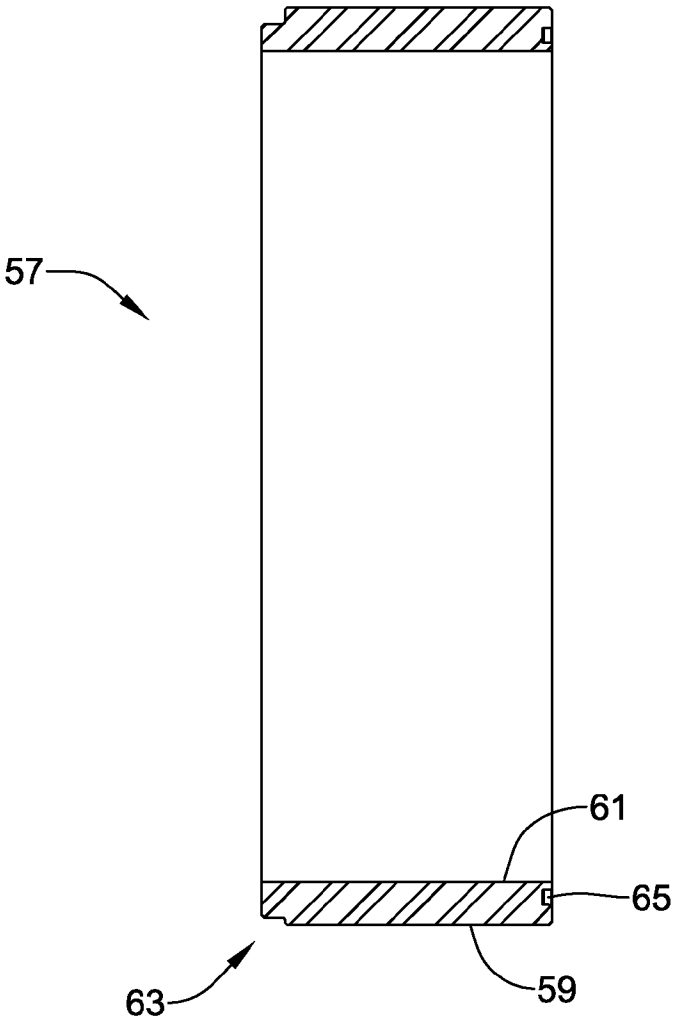
FIG. 6 is a cross-sectional view taken along line 6-6 of FIG. 5.
Figure 7:
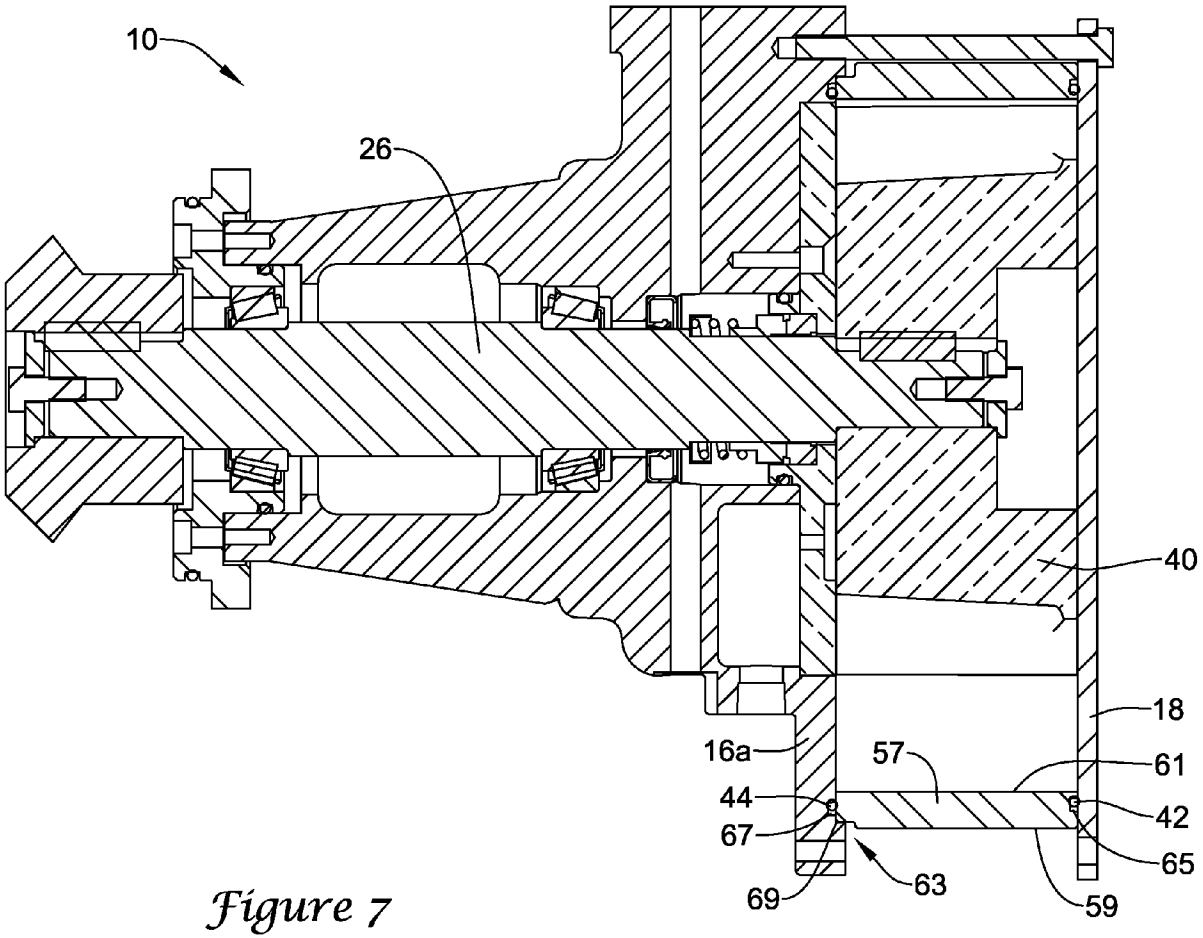
FIG. 7 is a schematic view of an illustrative liquid ring vacuum pump in accordance with an illustrative embodiment of the present invention.

FIGS. 3 and 4 illustrate an embodiment in which eccentric ring 56 is formed with inner annular surface 60 is defined by a circle that is offset from a circle defining outer annular surface 58. In some cases, however, it may be desirable to instead use an eccentric ring having an eccentric outer surface, sometimes only at one end of the ring. FIGS. 5, 6 and 7 demonstrate such an eccentric ring.

FIG. 5 is a perspective view of an eccentric ring 57, and FIG. 6 is a cross-sectional view taken along line 6-6 of FIG. 5. Eccentric ring 57 has an outer annular surface 59 with a concentric inner annular surface 61. Outer annular surface 59 may, if desired, include an annular notch or groove 63 that may be molded, milled, ground, or otherwise formed within outer annular surface 59 along the side of eccentric ring 57 that is disposed closest to a back plate such as back plate 16 (FIG. 2). A smaller groove 65 may be molded, milled, ground, or otherwise formed within an opposing edge of eccentric ring 57. Groove 65 may be configured to accommodate an O-ring such as first O-ring 42 (FIG. 2). In some cases, groove 65 may have dimensions slightly less than those of first O-ring 42, so that first O-ring 42 may extend out of groove 65 sufficiently to contact and seal against a cover plate such as cover plate 18 (FIG. 2).

In some cases, notch or groove 63 may be formed such that it has a depth (measured, for example, from outer annular surface 59) that varies depending on the radial position around eccentric ring 57. In some instances, the depth of notch or groove 63 may vary from a maximum depth at (in the illustrated orientation) a top of eccentric ring 57 to a minimum depth at the bottom of eccentric ring 57. In some cases, notch or groove 63 may be formed having a center of curvature that is offset about 0.050 inch from the central axis of the outer annular surface 59 and the inner annular surface 61, which may result in the remaining end portion of the eccentric ring 57 adjacent the notch or groove 63 having an effective thickness at the bottom of the ring 57 that is about 0.100 inch greater than the thickness of the top of eccentric ring 57.

FIG. 7 shows eccentric ring 57 disposed within vacuum pump 10. Impeller 40 is mounted to shaft 26, as previously described. Eccentric ring 57 is disposed between a back plate **16*a* and cover plate 18. Back plate 16*a* is similar to back plate 16 previously described, but includes a groove 67 that may be molded, milled, ground or otherwise formed within back plate 16***a* to accommodate an O-ring such as second O-ring 44 (FIG. 2). In some cases, groove 67 may have dimensions slightly less than those of second O-ring 44, so that second O-ring 44 may extend out of groove 67 sufficiently to contact and seal against eccentric ring 57.

In some cases, back plate 16*a* may be formed to have a step 69 that provides an annular surface against which the end of the ring 57 that includes annular notch or groove 63 may rotate. Because the notch or groove 63 is eccentric relative to the outer annular surface 59 and the inner annular surface 61 of the ring, when eccentric ring 57 rotates with respect to back plate 16*a* (and hence with respect to impeller 40) along step 69, the gap or tolerance between inner annular surface 61 of the ring and impeller 40 may be adjusted.

As discussed above with respect to eccentric ring 56 (FIGS. 3 and 4), in some cases, eccentric ring 57 may be rotated by loosening one or more of the plurality of bolts 50 so that eccentric ring 57 is free to rotate, then rotating eccentric ring 57, followed by re-tightening the loosened bolts 50. Likewise, it is contemplated that, for example, eccentric ring 57 may be rotated until it binds against impeller 40, and then reversed slightly. In some cases, eccentric ring 57 may include one or more setpoint markings that may be aligned against an alignment mark on back plate 16*a*. These setpoint markings may be used not only for guiding adjustments, but also for initial assembly, if desired.

In some cases, it may be desirable to completely remove cover plate 18 (FIG. 2) so that the gap or tolerance between eccentric ring 57 and impeller 40 may be visually or mechanically inspected. In some instances, a feeler gauge may be used to ascertain the gap or tolerance between eccentric ring 57 and impeller 40. In some cases, an acceptable tolerance between eccentric ring 57 and impeller 40 may be in the range of about 0.0040 inch to about 0.090 inch, but other tolerances may be used, as desired.

Figure 8:
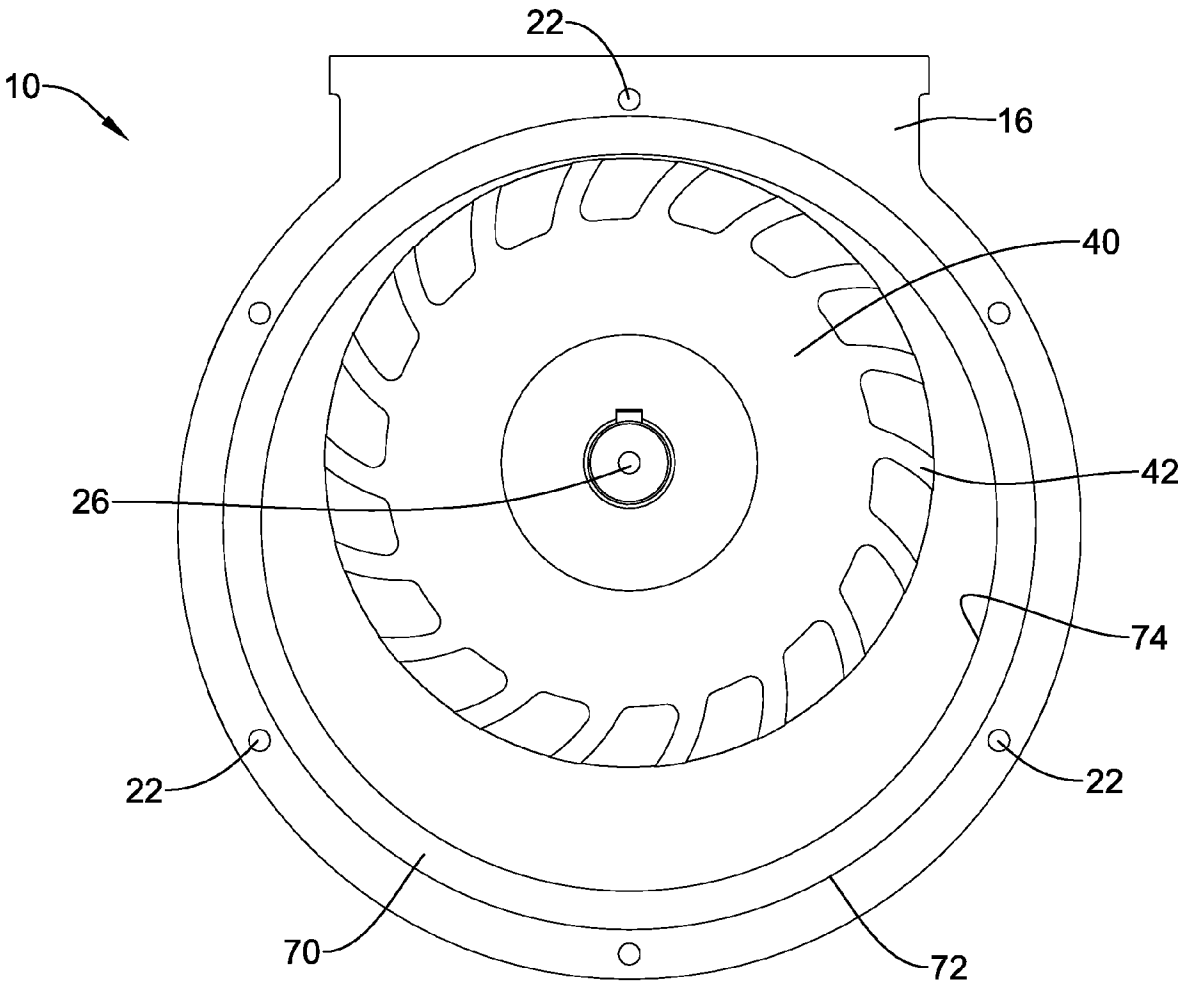
FIG. 8 is a schematic view of a concentric ring that may be used in conjunction with the present invention in an upward position.
Figure 9:
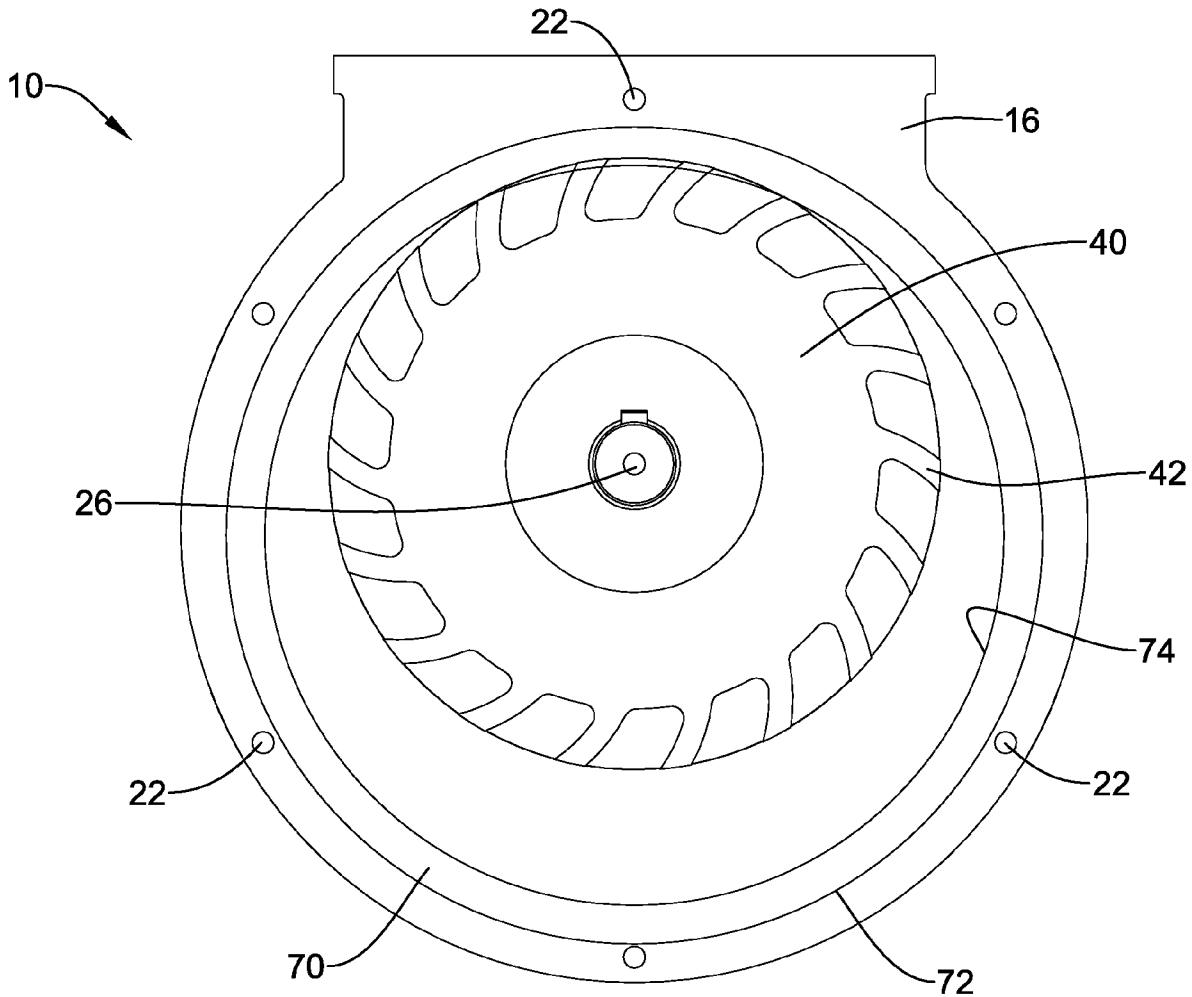
FIG. 9 is a schematic view of the concentric ring of FIG. 8 moved to a downward position.

In some cases, a gap or tolerance between impeller 40 and ring 20 (FIG. 2) may be adjusted by translating ring 20, rather than by rotating ring 20. FIGS. 8 and 9, in combination, illustrate how translating ring 20 may adjust the gap or tolerance between impeller 40 and ring 20.

In particular, FIG. 8 illustrates a concentric ring 70 disposed adjacent back plate 16 and impeller 40. Concentric ring 70 may be considered as having a uniform or at least substantially uniform wall thickness all the way or at least substantially all the way around concentric ring 70. In some cases, as illustrated, concentric ring 70 has, in cross-section, an outer surface 72 that is defined by a first circle and an inner surface 74 that is defined by a second circle. The first circle and the second circle, while not the same size, may have a common center.

It will be recognized that the position of impeller 40 is typically fixed by virtue of impeller 40 being secured to shaft 26. Thus, any change in the relative position of impeller 40 with respect to concentric ring 70 may be achieved by moving, or translating, concentric ring 70.

In FIG. 8, it can be seen that concentric ring 70 has been moved upwards (in the illustrated orientation) as far or nearly as far as possible, as concentric ring 70 is in close proximity, if not in actual contact, with threaded apertures 22 located at or near the top of back plate 16. This position may, for example, be used when impeller 40 and concentric ring 70 are new or at least have not substantially been worn. A small tolerance or gap can be seen between the top of impeller 40 and the top of concentric ring 70.

As impeller 40 and/or inner surface 74 of concentric ring 70 begin to wear, concentric ring 70 may be moved downwards to compensate for this wear. As discussed above with respect to FIG. 2, concentric ring 70 may be held in position by virtue of being sandwiched between cover plate 18 and back plate 16 by bolts 50. Thus, concentric ring 70 may be adjusted by loosening bolts 50 (FIG. 2), translating concentric ring 70, and then re-tightening bolts 50.

In some instances, concentric ring 70 may be adjusted by moving concentric ring 70 downward until it contacts impeller 40, and then moving the concentric ring 70 slightly upwards. In some cases, it may be useful to completely remove cover plate 18 so that the tolerance between the impeller 40 and the concentric ring 70 can be measured and/or visually inspect and/or clean the components underneath cover plate 18. As indicated above, in some instances, it may be useful to reverse cover plate 18 prior to reattachment.

To give a sense of the adjustment that can be made in the relative position of concentric ring 70, FIG. 9 shows concentric ring 70 moved downward (in the illustrated orientation) as far as it can go. i.e., outer surface 72 is in proximity to or even in contact with at least some of the threaded apertures 22 located at or near the bottom of back plate 18. At the same time, impeller 40 is represented in a pristine, or unworn, condition. It can be seen that some of the vanes 42 on impeller 40 extend into concentric ring 70. While this exact configuration is not workable, it provides an idea of illustrative adjustment ranges that are possible.

Figure 10:
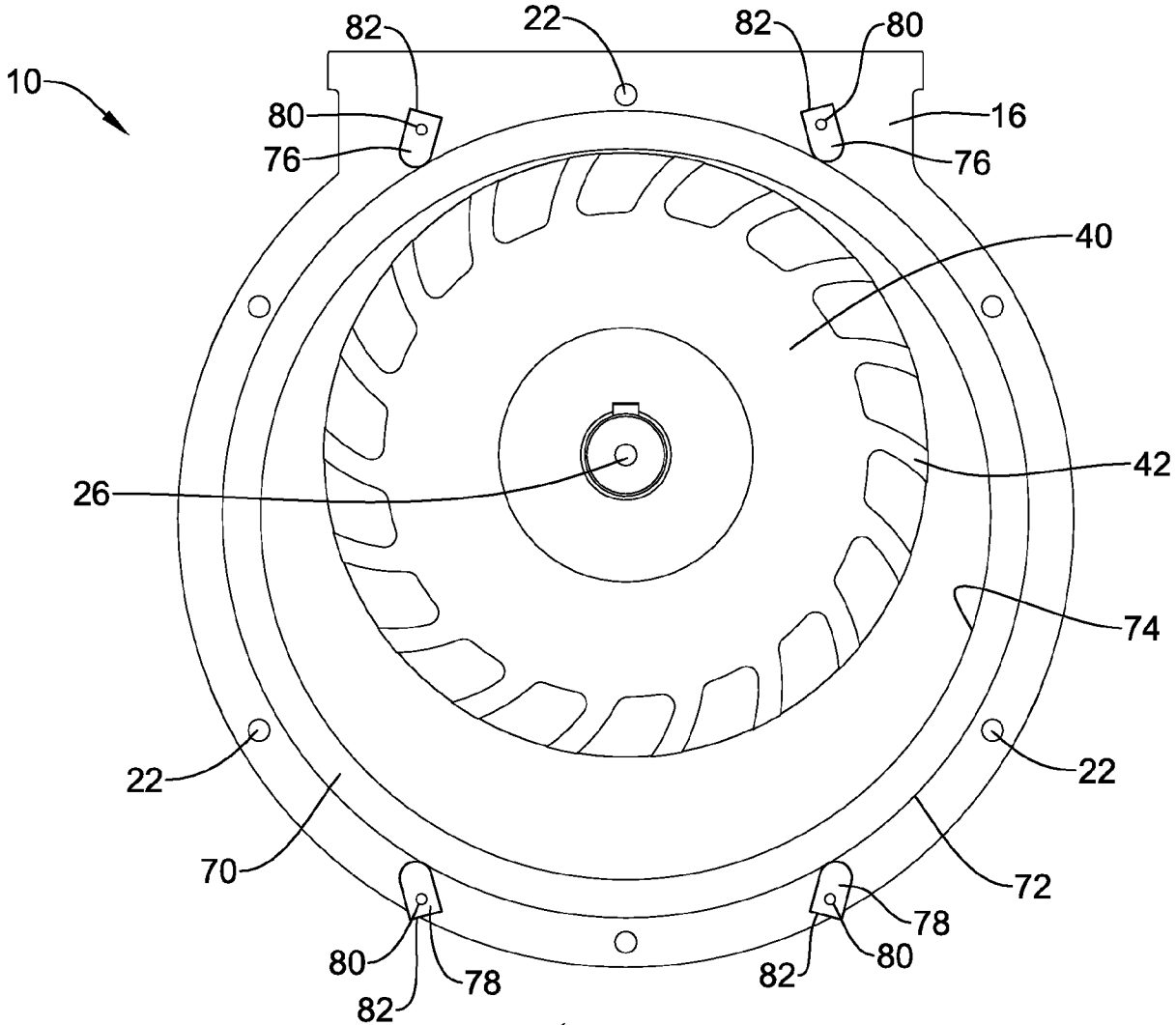
FIGS. 10 and 11 show illustrative adjustment structures in accordance with an illustrative embodiment of the present invention.
Figure 11:
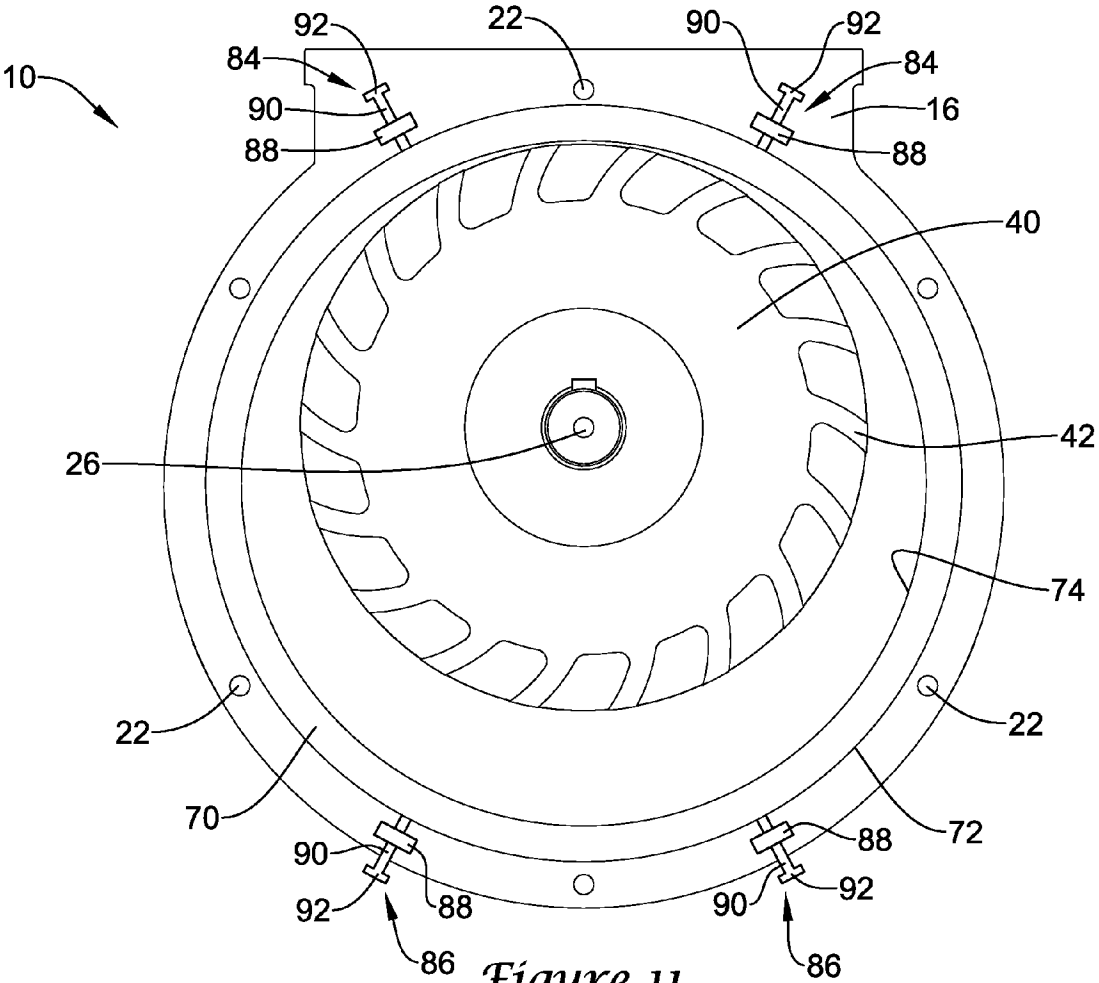

In some instances, it may be useful for vacuum pump 10 to include adjustment structure or structures are adapted to help make small translational adjustments in the position of concentric ring 70. FIGS. 10 and 11 show illustrative adjustment structures. FIG. 10 illustrates concentric ring 70 disposed adjacent back plate 16, with impeller 40 disposed within concentric ring 70.

In this Figure, it can be seen that vacuum pump 10 includes several eccentric cams 76 that are disposed near an upper (in the illustrated orientation) portion of concentric ring 70 as well as several eccentric cams 78 that are disposed near a lower portion of concentric ring 70. Eccentric cams 76 may be thought of as being positioned to exert a downward force on outer surface 72 of concentric ring 70, while eccentric cams 78 may be thought of as being positioned to provide a counterforce to that provided by eccentric cams 76.

In some cases, if desired, vacuum pump 10 may include one, two, three, or more eccentric cams 76 positioned along an upper portion of concentric ring 70 and one, two, three, or more eccentric cams 78 positioned along a lower portion of concentric ring 70.

Each eccentric cam 76 and each eccentric cam 78 may, if desired, pivot about an attachment point 80. In some cases, each attachment point 80 may be a screw, bolt or other fastener that may be loosened or tightened. In some cases, as illustrated, attachment points 80 are distinct from threaded apertures 22 that are used for securing cover plate 18. In some instances, attachment points 80 may simply be apertures that align with one or more of threaded apertures 22 and that permit bolts 50 to pass through attachment points 80, if desired.

In order to adjust the relative positions of each eccentric cam 76 and each eccentric cam 78, the attachment points 80 may be loosened. In some cases, a wrench or similar tool may be used to rotate one or more of the eccentric cams 76 and/or the eccentric cams 78. If desired, each eccentric cam 76 and each eccentric cam 78 may include a square or other shaped end 82 that facilitates adjustment with a wrench or similar tool.

In some cases, cover plate 18 (not seen in this Figure) may be loosened or even removed prior to adjusting the position of concentric ring 70 by rotating one or more of the eccentric cams 76 and one or more of the eccentric cams 78. If cover plate 18 is removed, a feeler gauge or similar instrument may be used to determine and set the gap or tolerance between inner annular surface 74 of concentric ring 70 and impeller 40. FIG. 11 provides an illustrative vacuum pump 10 that includes several adjustment structures 84 that are disposed along an upper (in the illustrated orientation) portion of concentric ring 70 and several adjustment structures 86 that are disposed along a lower portion of concentric ring 70. Adjustment structures 84 may be thought of as being positioned to exert a downward force on outer annular surface 72 of concentric ring 70 while adjustment structures 86 may be thought of as being positioned to provide a counterforce to that provided by adjustment structures 84.

In some cases, if desired, vacuum pump 10 may include one, two, three, or more adjustment structures 84 positioned along an upper portion of concentric ring 70 and one, two, three, or more adjustment structures 86 positioned along a lower portion of concentric ring 70.

Each of the adjustment structures 84 and each of the adjustment structures 86 include a base portion 88 that is welded, bolted, or otherwise attached to base plate 16. Each base portion 88 may include a threaded aperture that accommodates a threaded rod 90 having a handle portion 92. Handle portion 92 may be configured to permit hand operation. In some cases, handle portion 92 may be configured to accommodate a tool such as a wrench or a screwdriver. The threaded rods 90 may be turned in either direction, thereby either advancing or retracting the threaded rod 90.

Turning one of the threaded rods 90 in a first direction, such as clockwise, will cause the threaded rod 90 to advance towards concentric ring 70 and thus the threaded rod 90 may apply a force to concentric ring 70 sufficient to move concentric ring 70. Turning one of the threaded rods in a second direction, such as counter-clockwise, will cause the threaded rod 90 to retreat from the concentric ring 70.

Thus, to move concentric ring 70 in a downward direction, it may be useful to turn each of the threaded rods disposed within adjustment structures 84 in a clockwise direction while also turning each of the threaded rods 80 disposed within adjustment structures 86 in a counter-clockwise direction. It will be understood that it may be useful to either loosen or remove cover plate 18 prior to adjusting the position of concentric ring 70.

Figure 12:
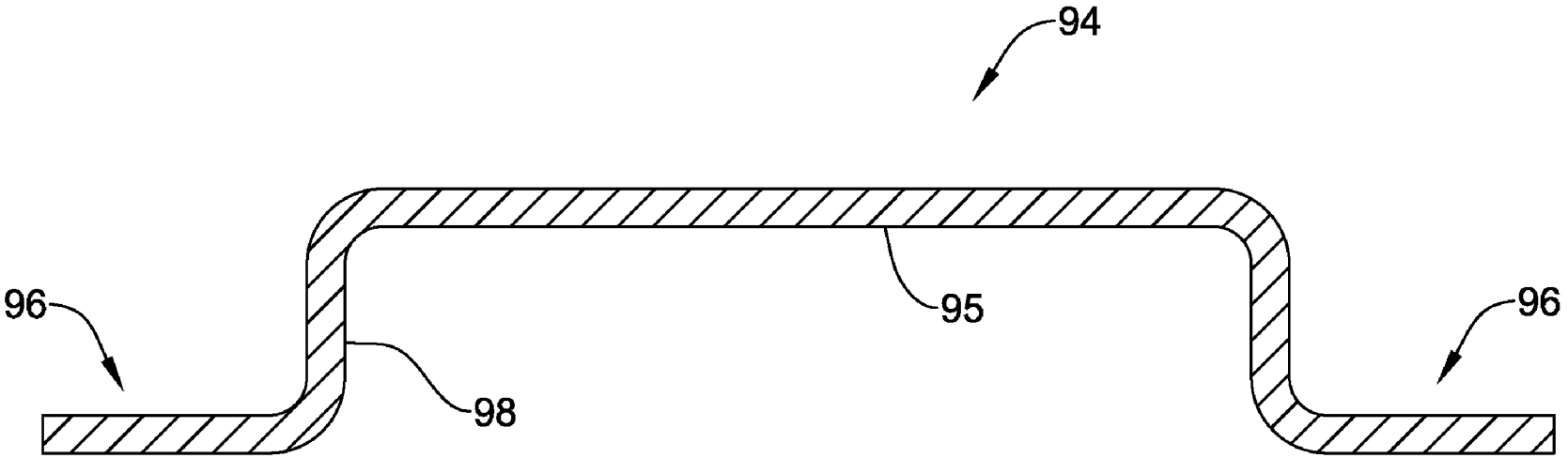
FIG. 12 shows a schematic cross-section of a cover that may be sized and configured to cover the impeller.

In each of the Figures discussed thus far, vacuum pump 10 has included a flat or relatively flat cover plate 18. It is contemplated, however, that vacuum pump 10 could instead employ a dish or bowl-shaped cover. FIG. 12 shows a schematic cross-section of a cover 94 that may be sized and configured to provide the function of the cover plate 18 and the ring 20 (FIG. 2). In some cases, cover 94 may include a flange portion 96 that permits cover 94 to be bolted to base plate 18, as discussed previously with respect to cover plate 18. Cover 94 may be seen as including a lower surface 95 disposed within flange portion 96. In some instances, the cover 94 itself may be translated to provide a particular gap or tolerance between impeller 40 and an inner surface 98 of cover 94.

Figure 13:
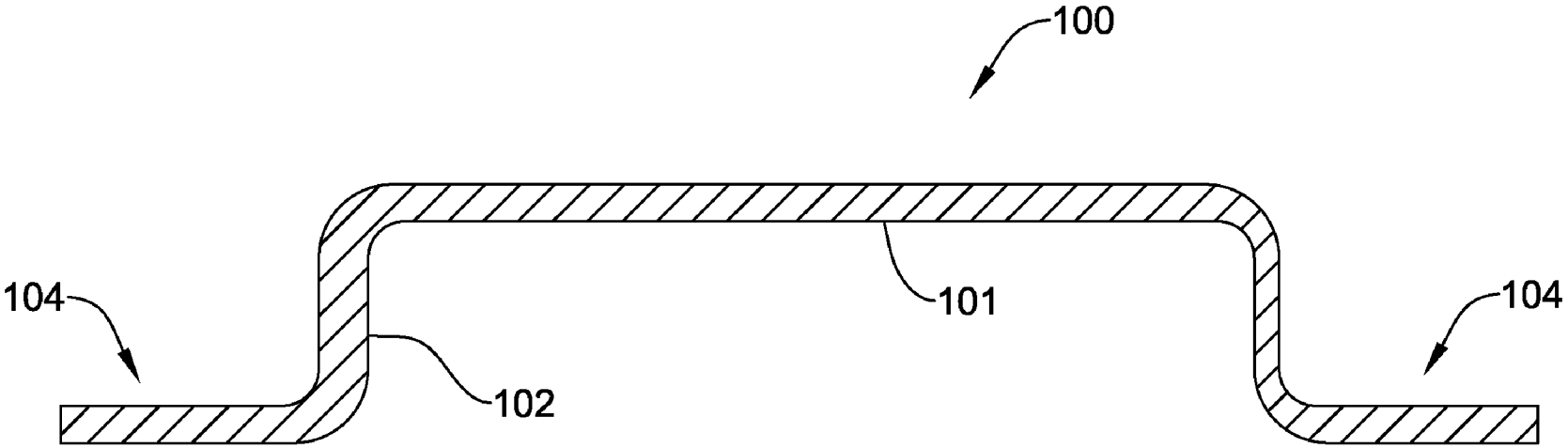
FIG. 13 shows a schematic cross-section of a cover having a varying wall thickness.

It is contemplated that a cover could also be rotated in order to adjust a gap or tolerance. FIG. 13 shows an illustrative cover 100 that may have a varying wall thickness (much like eccentric ring 56). A tolerance between impeller 40 and an inner surface 102 of cover 100 may be adjusted simply by rotating cover 100. A flange 104 may permit cover 100 to be bolted to base plate 16. Cover 100 may be seen as including a lower surface 101 disposed within flange portion 96. In some cases, flange 104 may include elongated bolt apertures that match the curve of cover 100 and that permit cover 100 to be rotated to achieve a desired tolerance.

Figure 14:
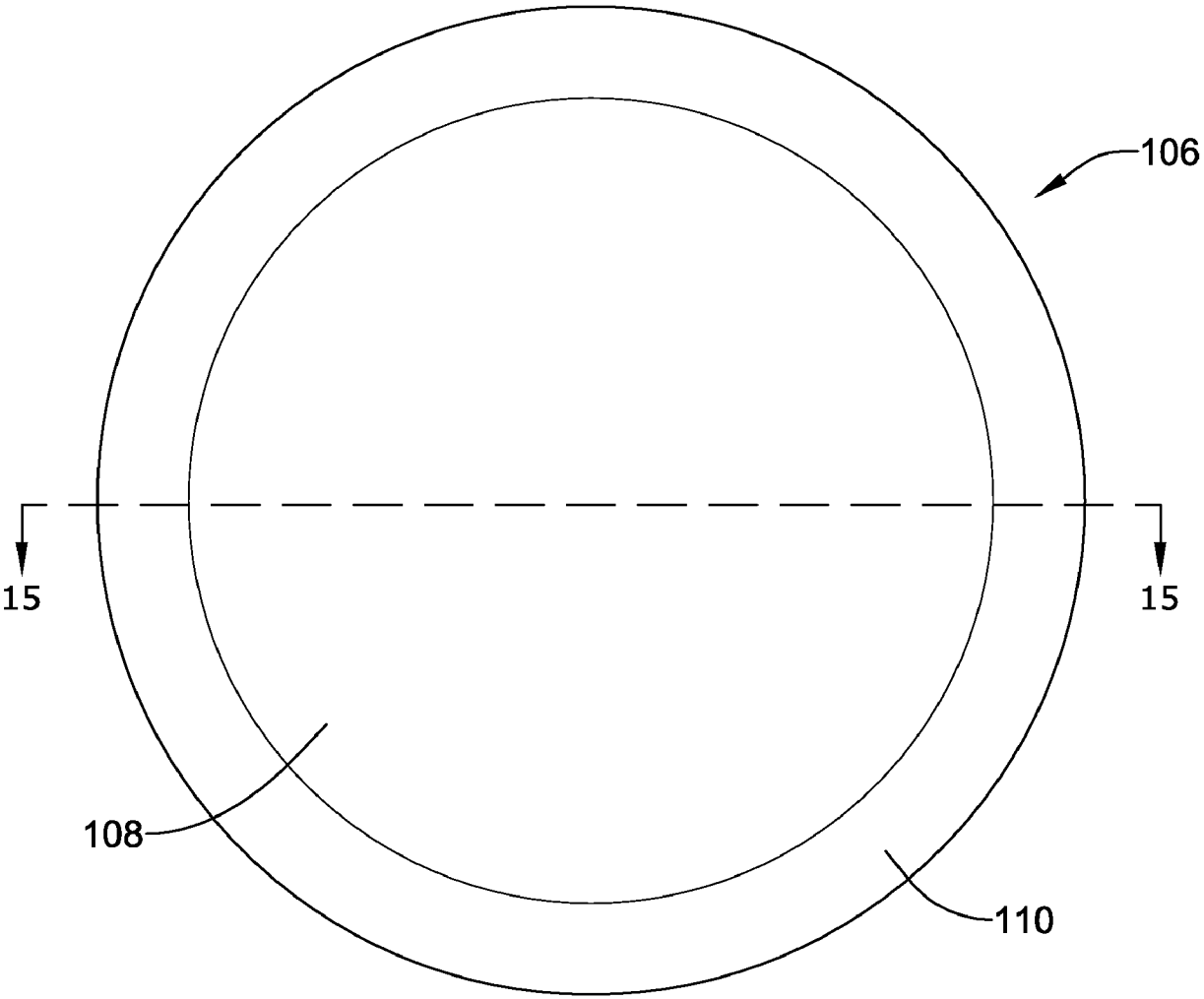
FIG. 14 is a top view of a cover in accordance with an illustrative embodiment of the present invention.
Figure 15:
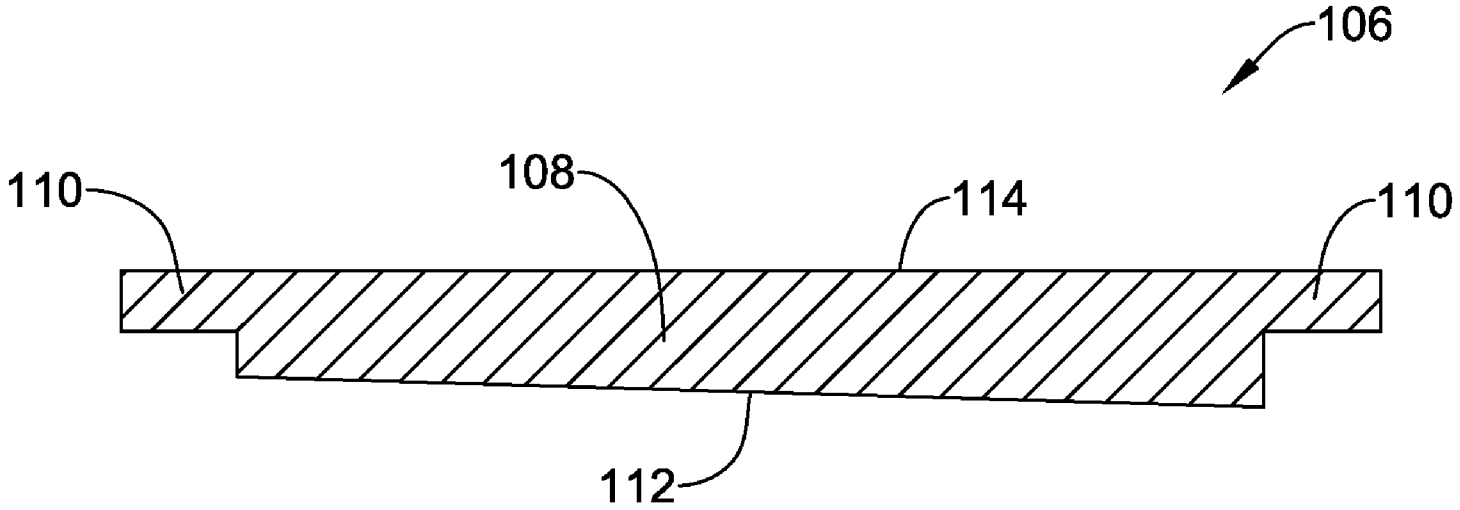
FIG. 15 is a cross-sectional view taken along line 15-15 of FIG. 14.

It will be recognized that minor manufacturing tolerances may exist in one or more of the components within liquid ring vacuum pump 10. In some cases, a tolerance or gap between cover plate 18 (or cover 94 or 100) and a side of impeller 40 (FIG. 2) may impact the performance and efficiency of liquid ring vacuum pump 10. FIGS. 14 and 15 show an illustrative cover 106 that may be used to compensate for manufacturing tolerances and/or for wear.

Cover 106 includes a cover portion 108 and a flange 110 that may be used for securing cover 106 to back plate 16 (or 16*a*) as discussed above. If desired, flange 110 may include any appropriate mounting apertures, adjustment structures, and the like. In FIG. 15, it can be seen that cover portion 108 has a lower surface 112 and an upper surface 114. Lower surface 112 is not parallel with upper surface 114. When secured to back plate 16 (or 16*a*) with an intervening ring, upper surface 114 may be parallel or at least substantially parallel with back plate 16 (or 16*a*).

In some instances, lower surface 112 may not be parallel with back plate 16 (or 16*a*), and thus lower surface 112 may not be parallel with a side of impeller 40 (FIG. 2). Therefore, it can be seen that a tolerance or gap between lower surface 112 and a side of impeller 40 may be adjusted by either rotating or translating cover 106 relative to impeller 40. In some cases, cover 106 may be rotated or translated to adjust a gap or tolerance between cover 106 and impeller 40 at a position adjacent to where the gap or tolerance between ring 20 (or eccentric ring 56, concentric ring 70 or eccentric ring 57, for example) is at a minimum. In a like manner, it is contemplated that the lower surfaces 95 and/or 101 of the covers shown in FIGS. 13 and 14 may also be angled (e.g. non-parallel) relative to the side of the impeller so that the gap or tolerance between the cover and the impeller may likewise be adjusted.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

I claim:

1. A liquid ring vacuum pump comprising:

a base plate;

an impeller rotatable with respect to the base plate, the impeller having two or more impeller blades each having an impeller blade end;

a ring disposed around the impeller and adjacent to the base plate, wherein an inner wall of the ring faces towards the impeller blade ends; and the inner wall of the ring is selectively movable along a range of motion that includes a first position where the inner wall of the ring is spaced from the impeller blade ends and a second position where the impeller blade ends would otherwise occupy the same space as the ring if the impeller were present.

2. The liquid ring vacuum pump of claim 1 further comprising a cover plate disposed over the ring, the cover plate secured relative to the base plate, wherein the cover plate spans the ring and extends beyond an outer dimension of the ring.

3. The liquid ring vacuum pump of claim 2, wherein the cover plate comprises a plurality of bolt apertures, the base plate comprises a plurality of threaded apertures, and the cover plate is secured relative to the base plate via a plurality of bolts extending through the plurality of bolt apertures into the plurality of threaded apertures.

4. The liquid ring vacuum pump of claim 3, wherein the plurality of bolts are disposed exterior to the ring when the plurality of bolts extend through the plurality of bolt apertures into the plurality of threaded apertures.

5. The liquid ring vacuum pump of claim 1, wherein the ring has an outer annular surface defined by a first circle and an inner annular surface defined by a second circle, the second circle being concentric with the first circle.

6. The liquid ring vacuum pump of claim 1, further comprising an adjustment structure that selectively moves the ring with respect to the impeller.

7. The liquid ring vacuum pump of claim 2, wherein at least one of the ring and the cover plate are sufficiently flexible to withstand water freezing within the liquid ring vacuum pump when the liquid ring vacuum pump is filled with a freezable fluid at an operational level.

8. The liquid ring vacuum pump of claim 1, wherein the ring comprises a polymeric material.

9. The liquid ring vacuum pump of claim 2, wherein the cover plate comprises a polymeric material.

10. A liquid ring vacuum pump comprising:

a base plate;

a ring disposed adjacent to the base plate; and an impeller disposed within the ring, wherein the ring has an inner surface that faces towards the impeller;

wherein the ring is selectively movable along a range of motion that includes a first position where the inner wall of the ring is spaced from the impeller, and a second position where at least part of the impeller would otherwise occupy the same space as the ring if the impeller were present, thereby allowing the ring to be moved to compensate for wear of the impeller and/or ring over time.

11. The liquid ring vacuum pump of claim 10, wherein the ring has a wall thickness that is at least substantially uniform.

12. The liquid ring vacuum pump of claim 10, further comprising one or more ring adjustment mechanisms.

13. The liquid ring vacuum pump of claim 12, wherein the one or more ring adjustment mechanisms are located exterior to the ring.

14. The liquid ring vacuum pump of claim 10, further comprising one or more eccentric cams rotatably fastened to the base plate such that the one or more eccentric cams may be rotated to exert a force on the ring.

15. The liquid ring vacuum pump of claim 10, further comprising one or more threaded apertures disposed adjacent the base plate and one or more threaded rods threadedly engaged within the one or more threaded apertures such that the one or more threaded rods may exert a force on the ring.

16. The liquid ring vacuum pump of claim 15, wherein each of the one or more threaded apertures are formed within a structure attached to and extending above the base plate.

17. A method of compensating for wear within a liquid ring vacuum pump comprising a base plate, a ring disposed proximate the base plate, an impeller disposed within the ring and a cover plate disposed over the ring, the method comprising the steps of:

loosening the cover plate;

moving the ring relative to the impeller until an inner surface of the ring contacts the impeller;

moving the ring away from the impeller by a distance; and tightening the cover plate.

18. The method of claim 17, wherein the distance corresponds to a desired tolerance between the ring and the impeller.

19. The method of claim 17, further comprising a step of removing the cover plate prior to moving the ring.

20. The method of claim 19, further comprising a step of measuring a tolerance between the impeller and the ring after moving the ring away from the impeller by a distance.

21. The method of claim 19, further comprising a step of reversing the cover plate prior to reattaching the cover plate.

22. The method of claim 17, wherein moving the ring comprises rotating one or more eccentric cams that are in contact with the ring.

23. The method of claim 17, wherein moving the ring comprises turning one or more threaded rods that are in contact with the ring.

24. A pump system comprising:

a main pump having a main pump inlet and a main pump outlet;

a liquid ring vacuum pump for creating a suction to help draw fluid to the main pump inlet to help prime the main pump, the liquid ring vacuum pump including:

a housing; and an impeller disposed proximate the housing;

wherein the housing is selectively movable relative to the impeller to change a distance between the impeller and the housing, wherein the housing is movable relative to the impeller along a range of motion that includes a first position where an inner surface of the housing is spaced from the impeller, and a second position where at least part of the impeller would otherwise occupy the same space as the housing if the impeller were present.

25. The pump system of claim 24, wherein the distance can be changed by translating the housing.

26. The pump system of claim 24, comprising an adjustment mechanism that permits the housing to selectively move relative to the impeller.

27. A method of adjusting a liquid seal vacuum pump comprising a housing and an impeller disposed proximate the housing, the method comprising the steps of:

starting with a distance between the housing the impeller, operating the liquid seal vacuum pump until the impeller and/or housing become worn and thus increase the distance between the housing and the impeller;

loosening at least a portion of the housing;

moving the loosened portion of the housing to obtain a desired tolerance between the housing and the impeller; and tightening the loosened portion of the housing.

28. The method of claim 27, wherein moving the loosened portion of the housing comprises translating the loosened portion of the housing with respect to the impeller.

* * * * *